US007585216B2

(12) United States Patent
Foster

(10) Patent No.: US 7,585,216 B2
(45) Date of Patent: Sep. 8, 2009

(54) SOUND GENERATING PUZZLE

(75) Inventor: Bruce Foster, Ellington, CT (US)

(73) Assignee: Hasbro, Inc., Pawtucket, RI (US)

( * ) Notice: Subject to any disclaimer, the term of this patent is extended or adjusted under 35 U.S.C. 154(b) by 330 days.

(21) Appl. No.: 10/648,453

(22) Filed: Aug. 26, 2003

(65) Prior Publication Data

US 2005/0049023 A1 Mar. 3, 2005

(51) Int. Cl.
*A63F 13/00* (2006.01)

(52) U.S. Cl. ..... 463/9

(58) Field of Classification Search ..... 273/157 R, 273/153 R

See application file for complete search history.

(56) References Cited

U.S. PATENT DOCUMENTS

| | | | | | |
|---|---|---|---|---|---|
| 3,863,931 | A | | 2/1975 | Forsyth et al. | 273/156 |
| 4,103,895 | A | | 8/1978 | Pressman et al. | 273/153 R |
| 4,317,011 | A | * | 2/1982 | Mazurk | 200/5 A |
| 4,796,891 | A | * | 1/1989 | Milner | 273/153 S |
| 4,820,236 | A | | 4/1989 | Berliner et al. | 446/369 |
| 4,893,817 | A | * | 1/1990 | Shilo | 273/157 R |
| 5,087,043 | A | * | 2/1992 | Billings et al. | 273/157 R |
| 5,090,701 | A | * | 2/1992 | Chang | 273/157 R |
| 5,190,287 | A | * | 3/1993 | Ishiyama | 273/156 |
| 5,205,557 | A | * | 4/1993 | Kuo | 273/153 S |
| 5,356,296 | A | * | 10/1994 | Pierce et al. | 434/317 |
| 5,466,181 | A | | 11/1995 | Bennett et al. | 446/297 |
| 5,588,240 | A | * | 12/1996 | Zilliox | 40/729 |
| 5,997,044 | A | | 12/1999 | Behm et al. | 283/83 |
| 6,168,494 | B1 | | 1/2001 | Engel et al. | 446/477 |
| 6,205,690 | B1 | * | 3/2001 | Heropoulos et al. | 40/442 |
| 6,347,813 | B1 | | 2/2002 | Star et al. | 283/83 |
| 6,419,543 | B1 | | 7/2002 | Burrows | 446/219 |
| 6,979,245 | B1 | * | 12/2005 | Goodwin | 446/149 |
| 2002/0111203 | A1 | * | 8/2002 | Chi | 463/9 |
| 2003/0162160 | A1 | * | 8/2003 | Horchler et al. | 434/406 |

FOREIGN PATENT DOCUMENTS

| | | | |
|---|---|---|---|
| FR | 2 629 731 | | 10/1989 |
| FR | 2629731 | A * | 10/1989 |
| GB | 2337942 | A * | 12/1999 |
| WO | WO 95/06503 | | 3/1995 |
| WO | WO 01/91867 | | 12/2001 |

* cited by examiner

*Primary Examiner*—Ronald Laneau
*Assistant Examiner*—Tramar Harper
(74) *Attorney, Agent, or Firm*—Marshall, Gerstein & Borun LLP

(57) ABSTRACT

A puzzle includes a base having a receiving area, a plurality of puzzle pieces sized for placement on the receiving area and adapted to form an assembled image, a sound generator, and an electrical circuit disposed beneath the receiving area and formed by a first substrate and a second substrate. Each of the substrates have conductive patterns, with at least one of the substrates operatively coupled to the sound generator. The conductive patterns are arranged for contact with each other upon depressing a selected portion of the receiving area to thereby activate the sound generator.

19 Claims, 7 Drawing Sheets

SOUND GENERATING PUZZLE

BACKGROUND OF THE INVENTION

The present invention is directed to puzzles. More specifically, the present invention is directed to a puzzle that generates sounds when one or more designated areas on the puzzle is depressed by a user.

Puzzles are generally known in the art. Puzzles are relatively simple for young users to enjoy and play with, yet the relatively uncomplicated puzzle pieces at times require thought to assemble into a completed image.

A puzzle having various features designed to enhance the play value of the toy may offer additional incentives and rewards to the user. Thus, puzzle designers continually seek additional ways to add features.

SUMMARY OF THE INVENTION

In one aspect, a puzzle comprises a base having a receiving area, a plurality of puzzle pieces sized for placement on the receiving area and cooperating to form an assembled image, a sound generator mounted to the base and arranged for connection to a power source, and a first substrate and a second substrate arranged for placement beneath the receiving area. The first substrate includes a conductive pattern operatively coupled to the sound generator, and the second substrate includes a conductive dot facing the conductive pattern and spaced away from the conductive pattern. The conductive dot and at least a portion of the conductive pattern may be disposed beneath a selected portion of the assembled image. The conductive dot and the conductive pattern are relatively displaceable to thereby permit contact between the conductive pattern and the conductive dot upon pressing the selected portion of the image such that the first and second substrates cooperate to form an electrical circuit thereby activating the sound generator.

In further accordance with a preferred example, each of the first and second substrates comprises a paperboard panel, with the conductive pattern and the conductive dot formed of a conductive ink. Further, the first substrate and the second substrate may be separated by third substrate having an aperture disposed adjacent the conductive pattern and the conductive dot. The first, second, and third substrates may be formed from a single paperboard blank, and preferably from the same paperboard blank, which may be die cut.

The first substrate may be separated from the third substrate by a first fold line, and the second substrate may be separated from the third substrate by a second fold line, with the fold lines permitting the first and second substrates to shift between unfolded positions and folded positions, with the third substrate disposed between the first and second substrates when the first and second substrates are in the folded position. In such an example, the first and second substrates may permit the conductive ink to be applied in a single printing operation. The conductive pattern may include a first portion and a second portion, and the conductive dot is arranged to connect the first portion and the second portion upon pressing the selected portion of the image. A plurality of conductive patterns and a plurality of conductive dots may be provided, and the assembled image may includes a plurality of selected portions such that the sound generator generates a distinct sound in response to pressing each of the plurality of selected portions. A plurality of tab-in-slot connections may be provided to help retain the substrates in the base.

In another aspect, a puzzle comprises a base having a receiving area, a plurality of puzzle pieces sized for placement on the receiving area and adapted to form an assembled image, a sound generator mounted to the base and arranged for connection to a power source, and an electrical circuit disposed beneath the receiving area and formed by a first substrate and a second substrate. Each of the substrates has formed thereon conductive patterns, the conductive pattern of at least one of the substrates operatively coupled to the sound generator, the conductive patterns on each of the substrates arranged for contact with each other upon depressing a selected portion of the receiving area to thereby activate the sound generator.

In a further aspect, a puzzle comprises a base having a receiving area, a plurality of puzzle pieces sized for placement on the receiving area and adapted to form an assembled image having a plurality of selected areas, a sound generator mounted to the base and arranged for connection to a power source, an electrical circuit disposed beneath the receiving area and formed by a first substrate and a second substrate, the first substrate having a plurality of conductive ink patterns, the second substrate having a plurality of conductive ink dots. The patterns of the first substrate are operatively coupled to the sound generator, and each dot is aligned with a corresponding one of the selected images and with a corresponding one of the patterns, with each dot cooperating with a corresponding one of the patterns to permit activation of the sound generator upon depressing one of the selected areas. A third substrate is positioned to maintain the dots and the patterns in spaced relation until the selected area is depressed.

DETAILED DESCRIPTION OF VARIOUS EMBODIMENTS

Figure 1:
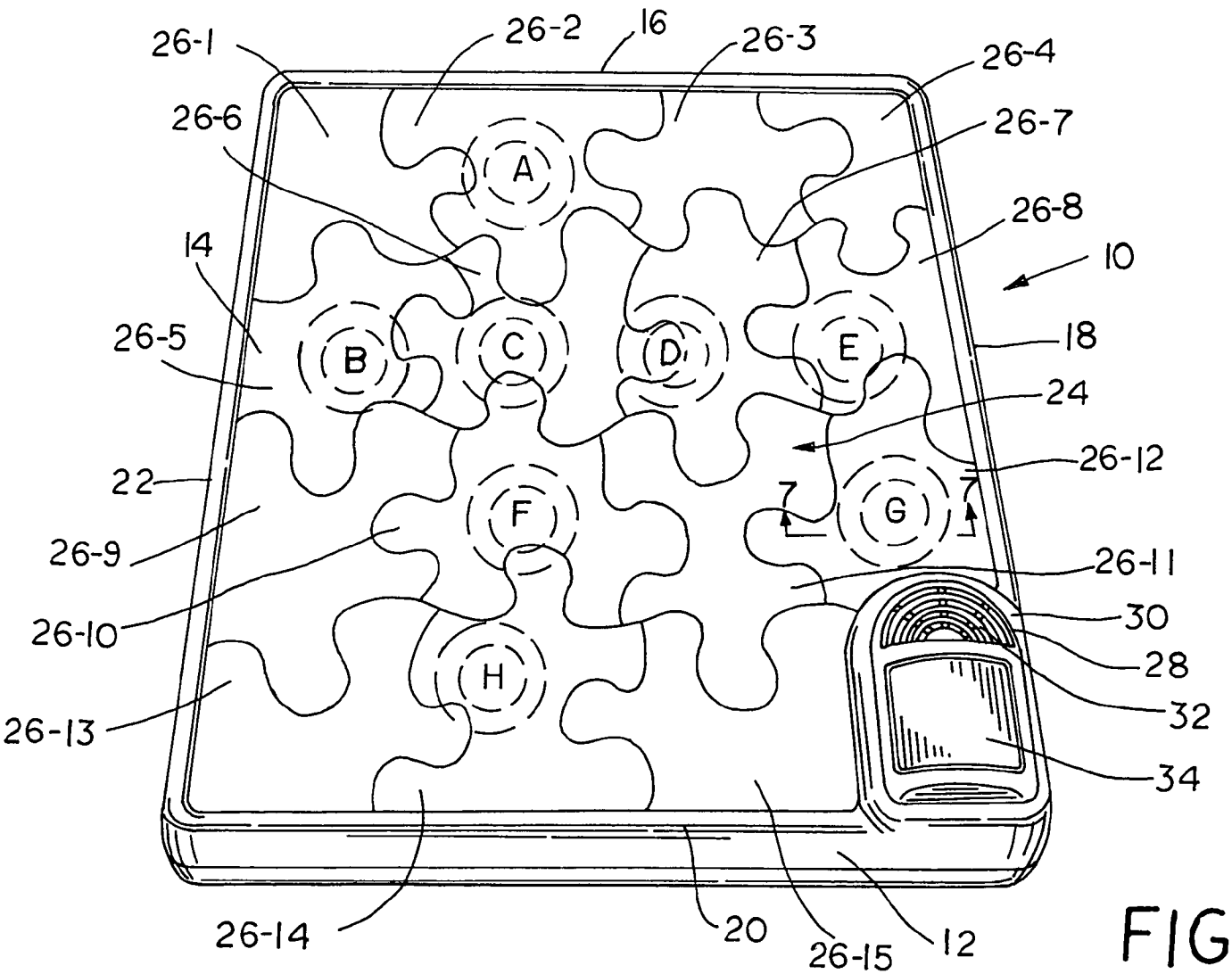
FIG. 1 is a perspective view of a sound generating puzzle assembled in accordance with the teachings of the disclosed example of the present invention.
Figure 2:
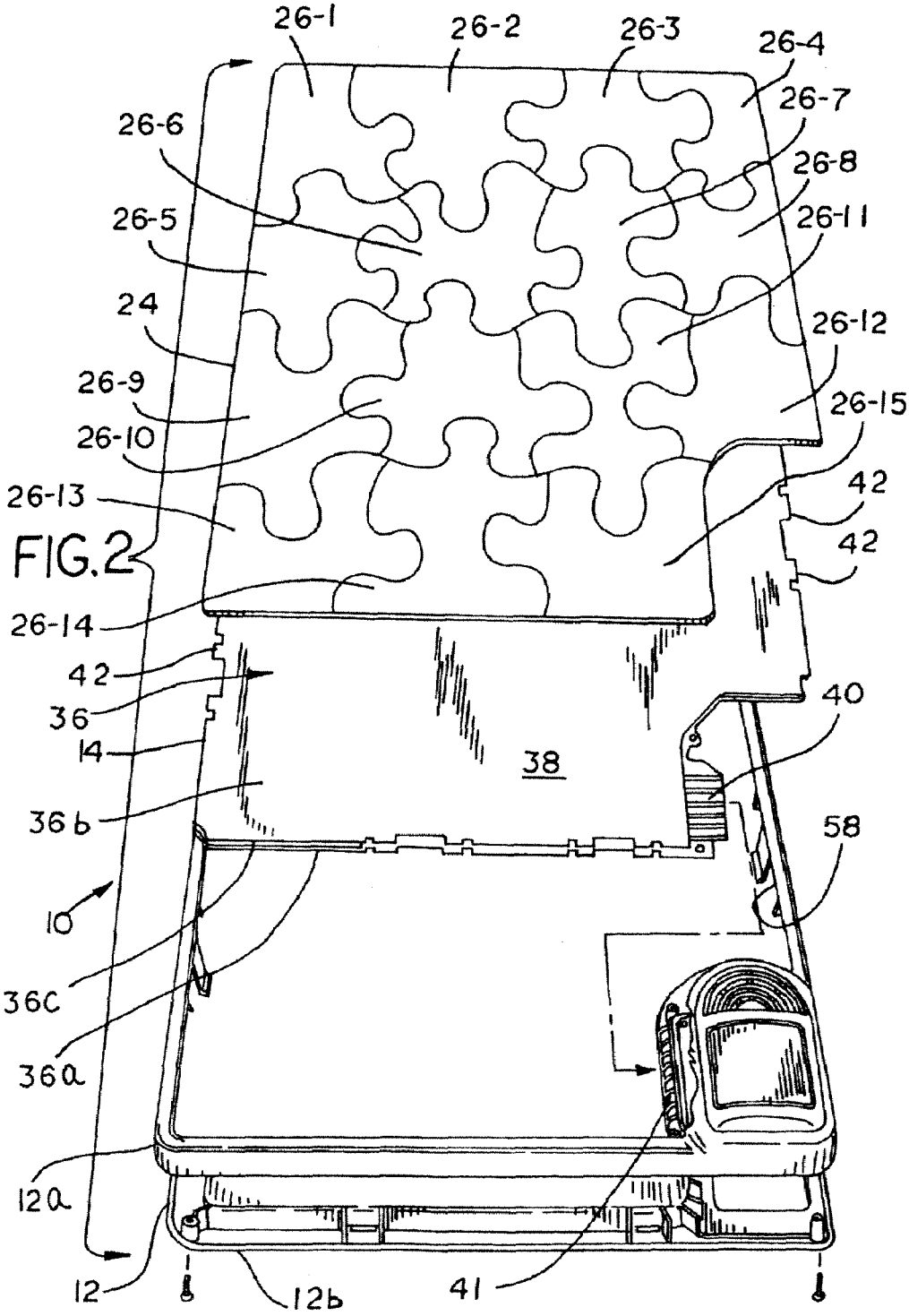
FIG. 2 is an exploded view in perspective thereof.

Referring now to FIGS. 1 and 2 of the drawings, a puzzle assembled in accordance with the teachings of the disclosed example of the present invention is shown and is generally referred to by the reference 10. The puzzle 10 includes a base 12 having a receiving area 14 which is generally surrounded by a plurality of sides 16, 18, 20 and 22. And assembled image 24 is constructed of a plurality of individual puzzle pieces 26-1 through 26-15. It will of course be appreciated that the exact number of individual puzzle pieces, as well as the exact nature of the assembled image 24, may very substantially in accordance with designer objectives. Further, it will be appreciated that the puzzle pieces and the assembled image 24 are sized to generally correspond to the size of the receiving area 14, such that the assembled image 24 may be generally surrounded by or bounded by the sides 16, 18, 20 and 22.

A sound generator 28 is mounted to the base 12 and, in the disclosed example is generally disposed within a housing 30 molded or otherwise formed in the base 12. Preferably, the sound generator 28 will include a speaker 32 and a re-set or activating button 34, and will be suitably equipped in a known a manner for attachment to a power source such as, for example, one or more batteries (not shown). The sound generator 28 is preferably a sound generating chip or Integrated Circuit (IC) of the type commonly found in the art and which is readily available from a variety of commercial sources. As would be known, the IC includes a memory and permits a desired sound recording or a plurality of sound recordings to be recorded and stored for later playback as desired.

The activating button 34 enables the sound generator 28 to be turned on or re-set as would be known (e.g., to be connected to or disconnected from the batteries, or to be re-set from a sleep mode as would be known). In the disclosed example, it will be appreciated that the assembled image includes one or more designated areas, indicated on FIG. 1 with the indicia A through H. It will be understood that the indicia A through H may take a variety of forms, as will be explained in greater detail below. It will also be noted that the receiving area 14 is generally defined on the base 12 so as to be recessed slightly relative to the surrounding edges 16, 18, 20 and 22.

Referring now to FIG. 2, the base at 12 is preferably separable into a pair of individual parts 12*a* and 12*b*, which may be secured using attachment screws, clips, taps, adhesives, or any other suitable mechanism. A substrate assembly 36 is sized to be disposed in the receiving area 14, with the substrate assembly 36 preferably disposed immediately beneath the puzzle pieces of the assembled image 24. The substrate assembly 36 includes a first panel or substrate 36a, a second panel or substrate 36b, and a third panel or substrate 36c. When the substrate assembly of 36 is situated as shown in FIG. 2, it will be appreciated that the assembled image 24 may be placed directly on a surface 38 of the substrate assembly 36. The substrate assembly 36 forms an electrical circuit 40 (only partially visible in FIG. 2), with the electrical circuit 40 being arranged for connection to the sounds generator 28 at a junction 41 as will be discussed in greater detail below. Preferably, the substrate assembly 36 is provided with a plurality of tabs 42 which may be sized to engage with a corresponding notch or recess 58 defined in the base 12 so as to help retain the substrate assembly 36 in the base 12.

Figure 3:
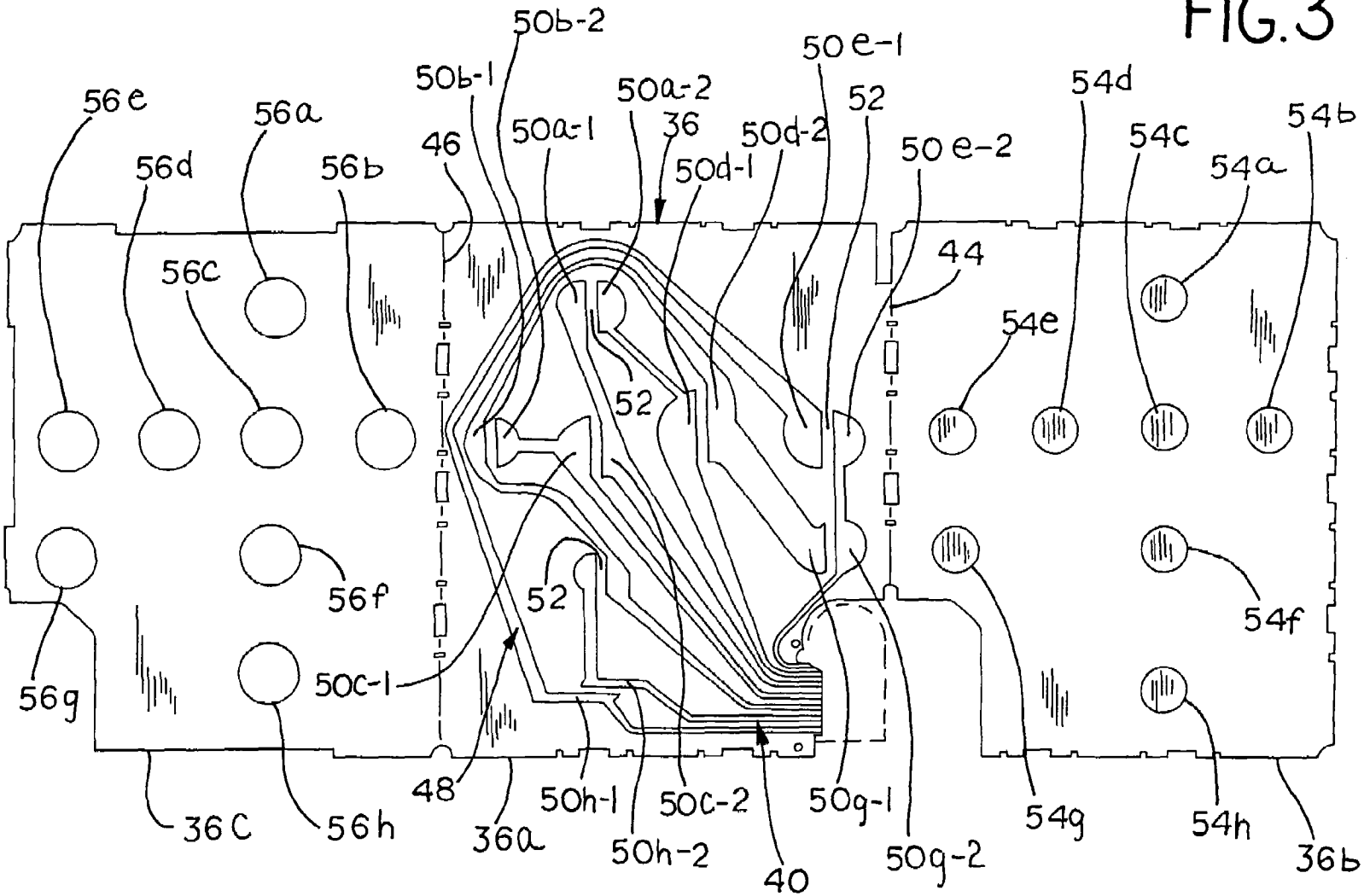
FIG. 3 is a plan view of the substrate assembly illustrated in an unfolded state.
Figure 4:
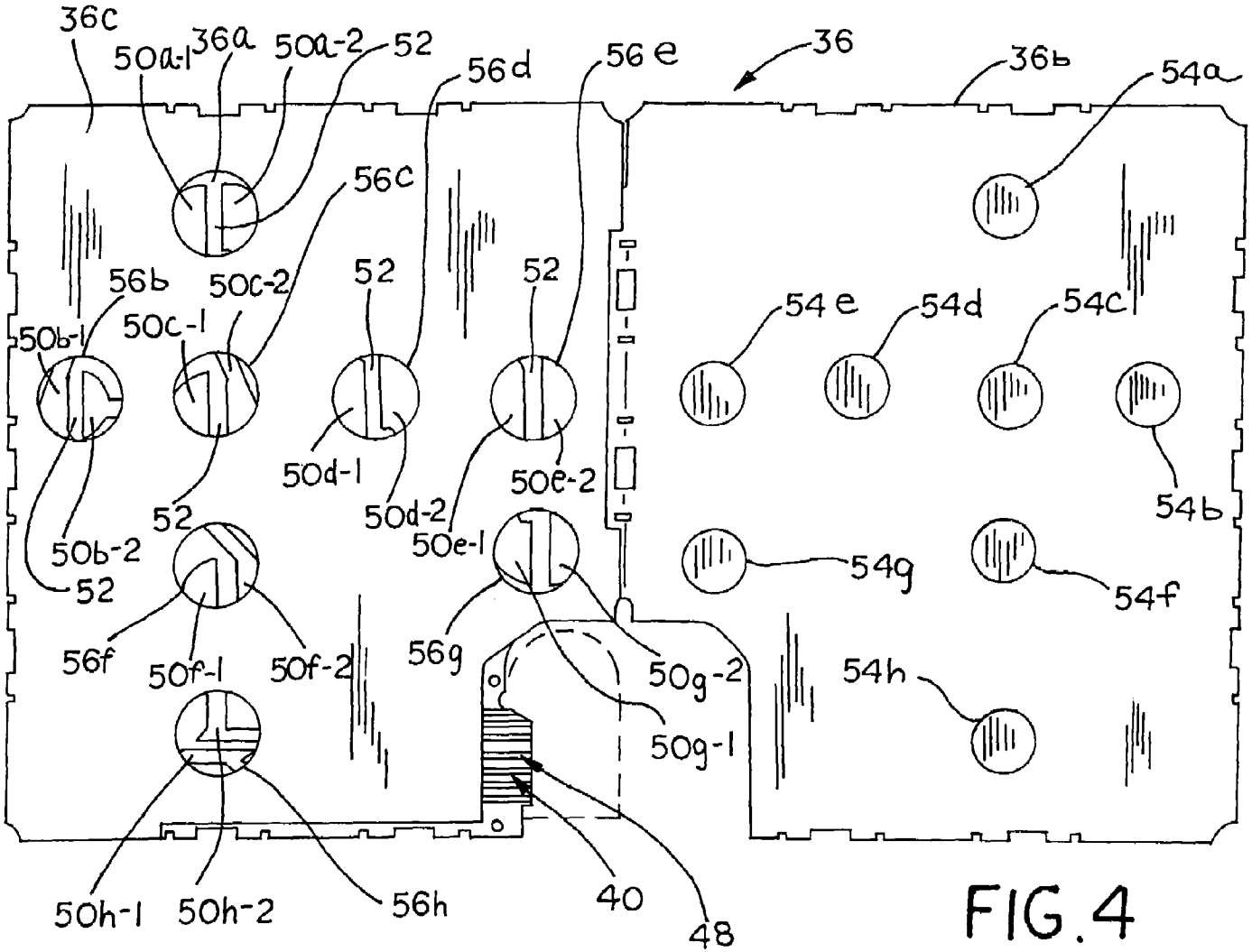
FIG. 4 is a plan view similar to FIG. 3 but illustrating the substrate assembly in one partially folded state.
Figure 5:
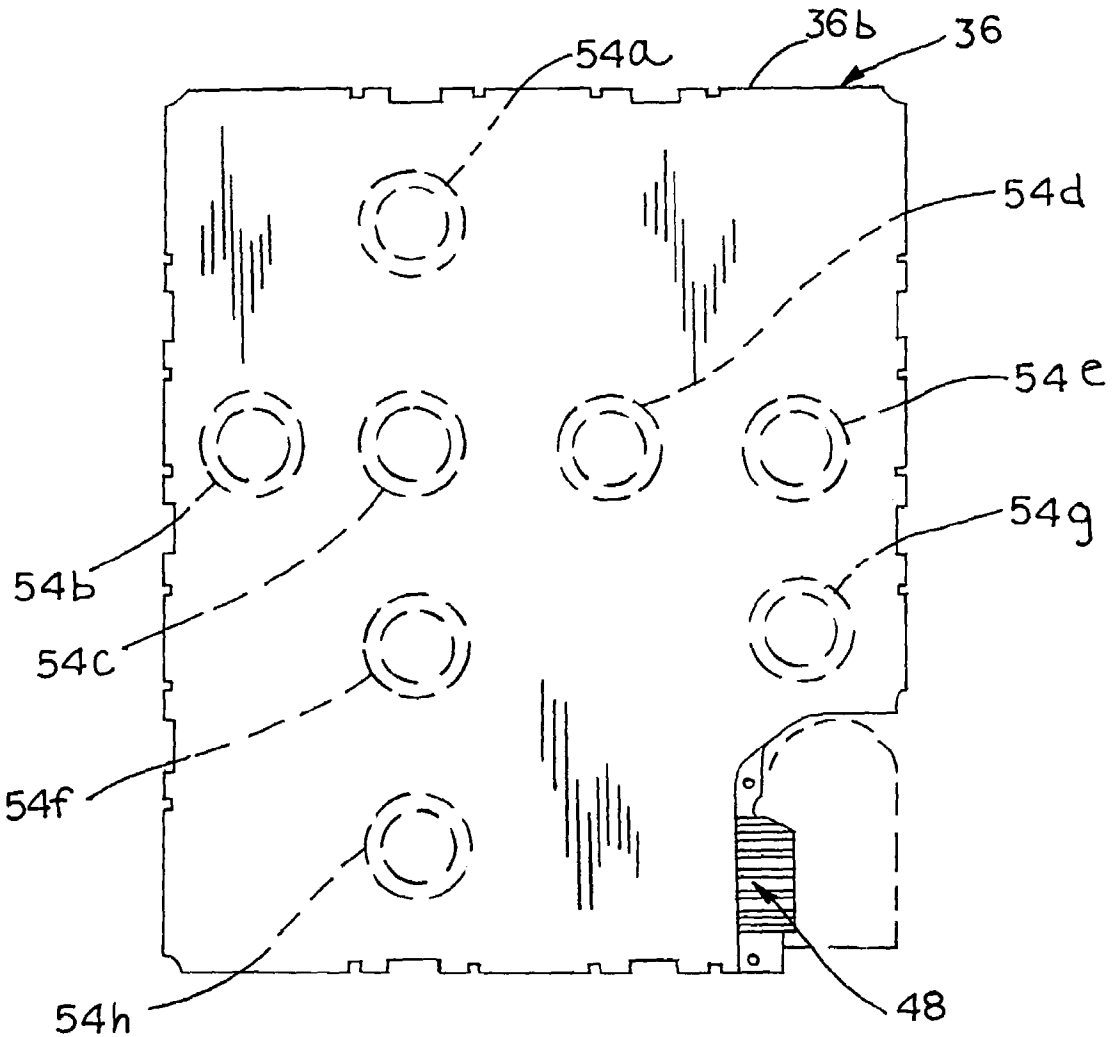
FIG. 5 is a plan view similar to FIGS. 3 and 4 but illustrating the substrate assembly and a fully folded state.

Referring now to FIGS. 3, 4 and 5, the substrate assembly 36 in accordance with the disclosed example and as outlined above is preferably formed of the three individual substrates 36*a*, 36*b* and 36*c*. The substrate 36*a* is separated from the substrate 36*b* by a fold line 44, while the substrate and 36*a* is separated from the substrate 36*c* by a fold line 46. The fold lines 44 and 46 may be formed by scoring, creasing, perforating, or by any other suitable methods. Alternatively, it will be understood that the substrates may be formed of individual and separate panels.

The substrate 36*a* includes a conductive pattern 48 which, in the disclosed example, is formed of a conductive ink. A suitable conductive ink is readily available from a variety of commercial sources. Preferably, in accordance with the disclosed example, the conductive pattern 48 on the substrate 36*a* includes a plurality of paired patterns 50. More specifically, the conductive pattern 48 includes a pair 50*a*-1 and 50*a*-2, 50*b*-1 and 50*b*-2, 50*c*-1 and 50*c*-2, 50*d*-1 and 50*d*-2, 50*e*-1 and 50*e*-2, 50*f*-1 and 50*f*-2, and 50*h*-1 and 50*h*-2.

It will be noted that, in the disclosed example, each half (50*a*-1, 50*b*-2, etc.) of each paired pattern is separated from its corresponding other half (50*a*-2, 50*b*-2, etc.) by a small gap 52. It will be noted that, in the disclosed example, each half may form part of another half. For example, it can be seen in FIG. 3 that the half 50*e*-2 is defined by the same strip of conductive ink that forms the half 50*g*-2. The substrate 36*b* includes a plurality of conductive dots 54*a*, 54*b*, 54*c*, 54*d*, 54*e*, 54*f*, 54*g*, 54*h*. Like the conductive pattern 48, the conductive dots 54*a*-*h* are formed of a conductive ink. It will be noted that the number of conductive dots 54*a*-*h* corresponds to the number of pairs in the conductive pattern 48. The substrate 36*c* includes a plurality of apertures 56*a*, 56*b*, 56*c*, 56*d*, 56*e*, 56*f*, 56*g* and 56*h*, with the number of apertures also corresponding to the number of conductive dots and the number of pairs in the conductive pattern 48. It will be appreciated that the pattern 48 and the conductive dots cooperate to form the electrical circuit when the dots are brought into contact with appropriate areas of the conductive pattern 48 as will be explained in greater detail below. Also, it will be appreciated that the conductive pattern and the conductive dots may be formed from any suitable conductive ink, such as a carbon-based ink which is readily available from a variety of commercial sources. Further, the pattern and dots may be applied to the substrate assembly using known printing methods or other suitable means.

As shown in FIG. 4, when the substrate 36*c* is folded as shown along the fold line 46, each of the individual apertures is disposed over the gap 52 of a corresponding pair of the electrical patterns 48. Consequently, and referring now to FIGS. 1 and 5, when the substrate 36*b* is folded along the fold line 44, each of the conductive dots becomes aligned with a corresponding one of apertures and with the gap 52 of the corresponding one called the conductive pair is in the conductive pattern 48.

Figures 8, 9:
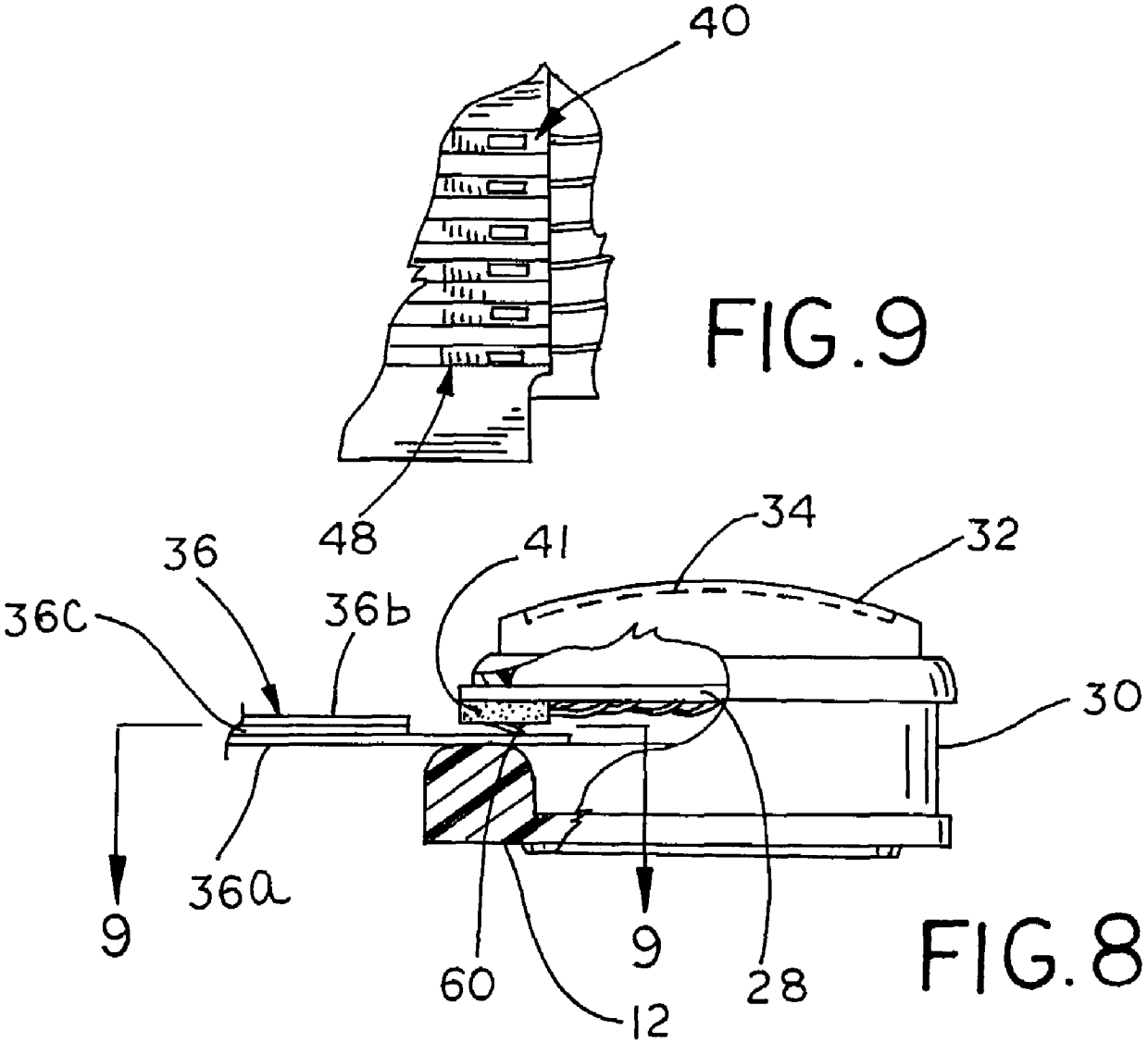
FIG. 8 is an enlarged fragmentary cross-sectional view illustrating an exemplary connection between the sound generator and one of the substrates of the substrate assembly.
FIG. 9 is an enlarged fragmentary plan view illustrating an exemplary conductive pattern on one of the substrates in the area of the connection between the substrate and the sound generator.

Referring now to FIGS. 8 and 9, the electrical circuit 40 is operatively coupled to the sound generator 28 at the junction 41. Thus, the sound generator 28 is preferably provided with one or more connectors or leads 60, each of which makes contact with a corresponding portion of the conductive pattern 48.

Figure 6:
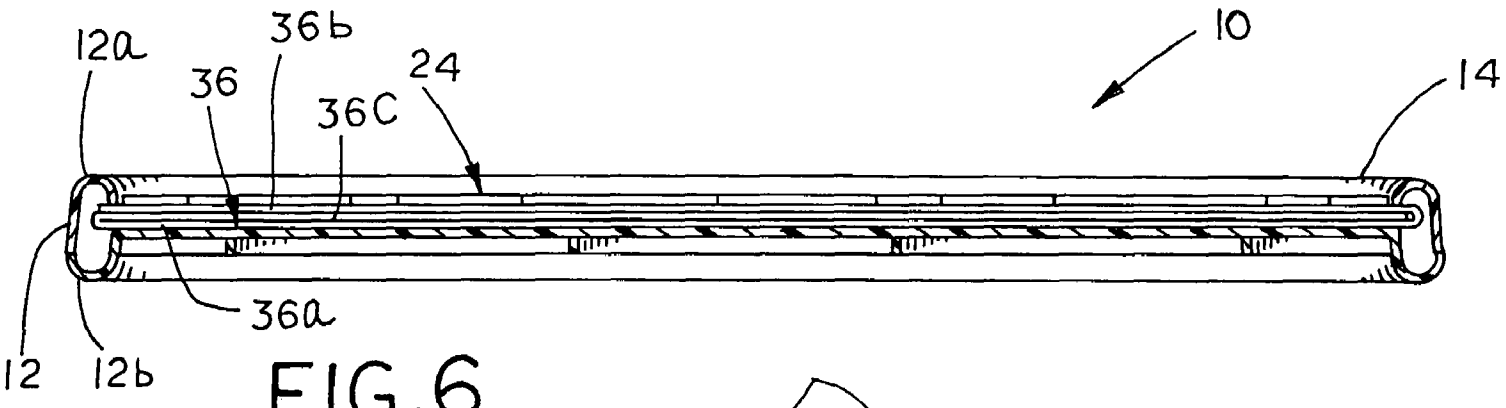
FIG. 6 is an enlarged cross-sectional view taken along line 6-6 of FIG. 1.
Figure 7:
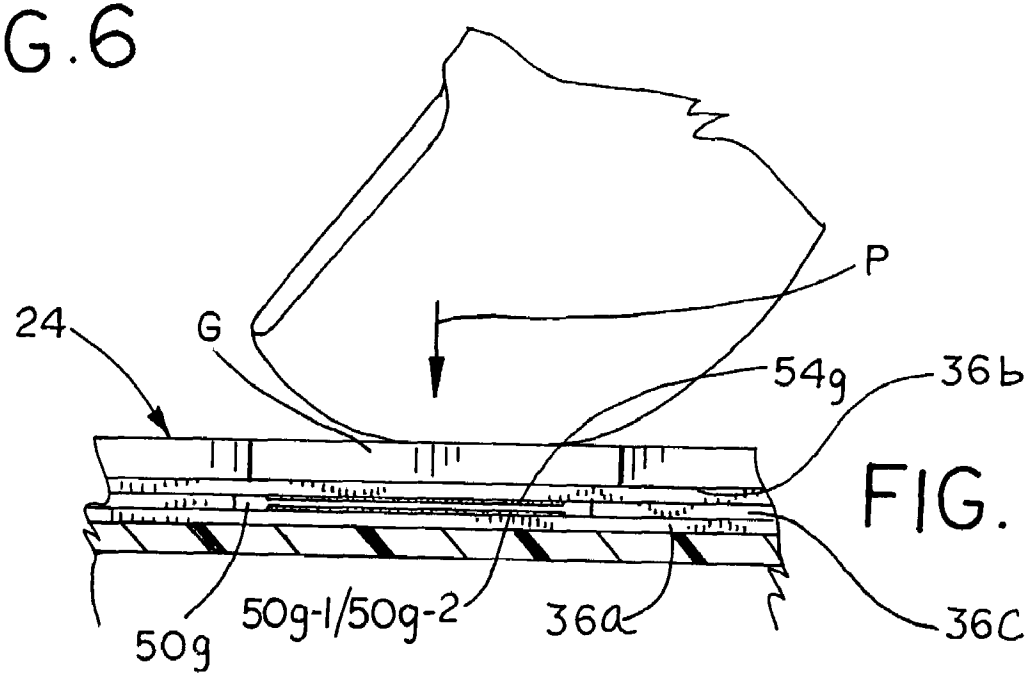
FIG. 7 is an enlarged fragmentary cross-sectional view taken along line 7-7 of FIG. 1 and illustrating a user pressing a designated area on the assembled image in order to activate the sound generator.

Referring now to FIGS. 6 and 7, the substrate assembly 36 is shown in position in the assembled base 12. It will be noted that a designated portion of the assembled image, in this case the designated portion indicated by the indicia G as shown in FIG. 1, is disposed over the downwardly facing conductive dot 54*g*, the aperture 56*g*, and the gap 52 of the conductive pair 50*g*-1 and 50*g*-2. Thus, upon the application of a downward force supplied by a user and as indicated by the reference arrow P, the conductive dot 54*g* is displaced through the corresponding aperture 56*g* sufficiently to make contact with the appropriate portion of the conductive pattern 48. Thus, the electrical circuit 40 is closed and the sound generator 28 is activated. Thus, it will be appreciated that the conductive dots 54A-H and their corresponding pairs of patterns 50*a*-1/50*a*-2 through 50*a*-*h*/50*h*-2 function together as electrical switches.

It will be appreciated that, in accordance with the disclosed example, the sound generator 28 can generate a number of distinct sounds. For example, each of the sounds generated by the sound generator 28 may correspond in some way to the indicia A through H on the face of the assembled image 24. For example, the indicia A may represent a cow, and the sound generated upon activating that designated area may be the sound of a cow mooing. Another possible example would be generating a sound of a cat to correspond to the image of a cat, or generating the sound of a bird to correspond to the image of a bird. Of course the possibilities are not limited to animals, as other sounds chosen to correspond or otherwise be suggestive of other desired images may be used.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A puzzle comprising:

a base having a receiving area;

a plurality of removable puzzle pieces, the puzzle pieces sized for placement on the receiving area and cooperating to form an assembled image;

a sound generator mounted to the base and arranged for connection to a power source;

a first substrate and a second substrate arranged for placement beneath the receiving area, the first and second substrates formed from the same folded piece of a single paperboard blank, the first substrate having a conductive pattern operatively coupled to the sound generator, the second substrate having a conductive dot facing the conductive pattern and spaced away from the conductive pattern, the conductive dot and at least a portion of the conductive pattern disposed beneath a selected portion of the image;

the conductive dot and the conductive pattern both formed of a conductive ink and being relatively displaceable to thereby permit contact between the conductive pattern and the conductive dot upon pressing the selected portion of the image on one of the removable puzzle pieces such that a lower surface of the puzzle piece directly contacts an upper one of the first or second substrates such that the first and second substrates cooperate to form an electrical circuit, thereby activating the sound generator.

2. The puzzle of claim 1, wherein the first substrate and the second substrate are separated by third substrate, the third substrate having an aperture disposed adjacent the conductive pattern and the conductive dot.

3. The puzzle of claim 1, including a third substrate adapted for placement between the first and second substrates, the third substrate including an aperture located for placement between the conductive pattern and the conductive dot.

4. The puzzle of claim 3, wherein the first substrate is separated from the third substrate by a first fold line, and wherein the second substrate is separated from the third substrate by a second fold line, the fold lines permitting the first and second substrates to shift between unfolded positions and folded positions, the third substrate disposed between the first and second substrates when the first and second substrates are in the folded position.

5. The puzzle of claim 1, wherein the paperboard blank is die cut.

6. The puzzle of claim 1, wherein the first and second substrates are adapted to permit the conductive ink to be applied in a single printing operation.

7. The puzzle of claim 1, wherein the conductive pattern includes a first portion and a second portion, and wherein the conductive dot is arranged to connect the first portion and the second portion upon pressing the selected portion of the image.

8. The puzzle of claim 1, wherein the first substrate includes a plurality of conductive patterns, the second substrate includes a plurality of conductive dots, and the assembled image includes a plurality of selected portions, and wherein the sound generator is arranged to generate a distinct sound in response to pressing each of the plurality of selected portions.

9. The puzzle of claim 1, wherein the substrates include a plurality of tabs, and wherein the base includes a plurality of slots sized to receive the tabs to thereby retain the substrates in the base.

10. A puzzle comprising:

a base having a receiving area;

a plurality of removable puzzle pieces, the puzzle pieces sized for placement on the receiving area and each puzzle piece having an image adapted to form an assembled image;

a sound generator mounted to the base and arranged for connection to a power source;

an electrical circuit disposed beneath the receiving area and formed by a first substrate and a second substrate, both of the substrates formed from connected portions of the same folded paperboard panel and having formed thereon conductive patterns formed of conductive ink, the conductive pattern of at least one of the substrates operatively coupled to the sound generator, the conductive patterns on each of the substrates arranged for contact with each other upon depressing a selected portion of the receiving area to thereby activate the sound generator, wherein a lower surface of the puzzle piece directly contacts an upper one of the first or second substrates when the selected portion of the receiving area is depressed.

11. The puzzle of claim 10, wherein the first substrate and the second substrate are separated by a third substrate, the conductive pattern on the second substrate comprising a dot, the third substrate having an aperture disposed for alignment with the conductive dot.

12. The puzzle of claim 11, wherein the first, second and third substrates are formed from a single die cut paperboard blank.

13. The puzzle of claim 12, wherein the first substrate is separated from the third substrate by a first fold line, and wherein the second substrate is separated from the third substrate by a second fold line, the fold lines permitting the first and second substrates to shift between unfolded positions and folded positions, the third substrate disposed between the first and second substrates when the first and second substrates are in the folded position.

14. The puzzle of claim 10, wherein the conductive patterns comprise conductive ink, and wherein the first and second substrates are adapted to permit the conductive ink to be applied to both substrates in a single printing operation.

15. The puzzle of claim 10, wherein the conductive pattern on the first substrate comprises a first portion and a second portion, and wherein the conductive pattern on the second substrate is arranged to connect the first portion of the pattern to the second portion of the pattern upon pressing the selected portion of the image.

16. The puzzle of claim 10, wherein the conductive pattern on the second substrate comprises a plurality of dots and wherein the first substrate includes a plurality of conductive patterns, each of the dots of the second substrate positioned to cooperate with one of the plurality of conductive patterns of the first substrate, the assembled image including a plurality of selected portions, each selected portion overlying a corresponding one of the dots, and wherein the sound generator is arranged to generate a distinct sound in response to pressing each of the selected portions.

17. A puzzle comprising:

a base having a receiving area;

a plurality of puzzle pieces, the puzzle pieces sized for placement on the receiving area and adapted to form an assembled image having a plurality of selected areas;

a sound generator mounted to the base and arranged for connection to a power source;

a substrate assembly including a first substrate, a second substrate, and a third substrate;

an electrical circuit disposed beneath the receiving area and formed by the first substrate and the second substrate, the first substrate having a plurality of conductive ink patterns, each pattern comprising a first half and a second half separated from the first half by a gap, the second substrate having a plurality of conductive ink dots, the patterns of the first substrate operatively coupled to the sound generator, each dot aligned with a corresponding one of the selected images and with a corresponding one of the patterns, each dot cooperating with a corresponding one of the patterns to electrically connect the first and second halves of the pattern to permit activation of the sound generator upon depressing one of the selected areas;

the third substrate positioned to maintain the dots and the patterns in spaced relation until the selected area is depressed; and the first, second and third substrates formed from the same paperboard panel and connected to one another by fold lines.

18. A puzzle comprising:

a base having a receiving area;

a plurality of puzzle pieces, the puzzle pieces sized for placement on the receiving area and adapted to form an image having a plurality of selected areas;

a sound generator mounted to the base and arranged for connection to a power source;

an electrical circuit assembly disposed beneath the receiving area and formed by first and second substrates, the first and second substrates operatively coupled to one another and formed of the same folded paperboard material, the first substrate having a plurality of conductive ink patterns, the second substrate having a plurality of conductive ink dots, the patterns of the first substrate operatively coupled to the sound generator, each of the plurality of dots aligned with a corresponding one of the selected images and with a corresponding one of the patterns, each dot cooperating with a corresponding one of the plurality of patterns to permit activation of the sound generator upon depressing one of the selected areas;

a third substrate positioned to maintain the dots and the patterns in spaced relation until the selected area is depressed; and the first, second and third substrates having the same thickness and formed of the same material.

19. The puzzle of claim 18, wherein the first, second, and third substrates are all formed of the same paperboard material folded along a plurality of fold lines.

* * * * *